US009139330B2

(12) United States Patent
Gomez

(10) Patent No.: US 9,139,330 B2
(45) Date of Patent: Sep. 22, 2015

(54) CLAMSHELL CARTON WITH CONVERTIBLE TRAY

(71) Applicant: Carlos H Gomez, Denver, CO (US)

(72) Inventor: Carlos H Gomez, Denver, CO (US)

( * ) Notice: Subject to any disclaimer, the term of this patent is extended or adjusted under 35 U.S.C. 154(b) by 0 days.

(21) Appl. No.: 14/053,830

(22) Filed: Oct. 15, 2013

(65) Prior Publication Data

US 2014/0103102 A1 Apr. 17, 2014

Related U.S. Application Data

(60) Provisional application No. 61/713,677, filed on Oct. 15, 2012.

(51) Int. Cl.

| | |
|---|---|
| ***B65D 5/66*** | (2006.01) |
| ***B65D 5/54*** | (2006.01) |
| ***B31B 1/16*** | (2006.01) |
| ***B31B 1/25*** | (2006.01) |
| ***B31B 1/88*** | (2006.01) |

(52) U.S. Cl.

CPC ..... *B65D 5/6661* (2013.01); *B31B 1/16* (2013.01); *B31B 1/25* (2013.01); *B31B 1/88* (2013.01); *B65D 5/545* (2013.01); *B65D 5/667* (2013.01)

(58) Field of Classification Search

USPC ..... 229/103, 114, 236; 493/54, 59, 162

See application file for complete search history.

(56) References Cited

U.S. PATENT DOCUMENTS

| | | | | | |
|---|---|---|---|---|---|
| 2,133,701 | A | * | 10/1938 | Holmes et al. | 229/236 |
| 2,266,649 | A | * | 12/1941 | Marshall | 229/243 |
| 2,758,774 | A | * | 8/1956 | Grunert et al. | 229/117.07 |
| 2,944,721 | A | * | 7/1960 | Choate | 229/171 |
| 3,155,234 | A | * | 11/1964 | Knoll et al. | 206/232 |
| 3,659,772 | A | * | 5/1972 | Dorsey et al. | 229/5.85 |
| 4,232,816 | A | * | 11/1980 | Johnson et al. | 229/114 |
| 4,371,110 | A | * | 2/1983 | Kulig | 229/122 |
| 4,643,315 | A | * | 2/1987 | Hopwood et al. | 229/236 |
| 5,148,972 | A | * | 9/1992 | Clayton | 229/113 |
| 5,205,476 | A | * | 4/1993 | Sorenson | 229/114 |
| 5,671,883 | A | * | 9/1997 | Philips | 229/236 |
| 6,059,179 | A | * | 5/2000 | Giampapa | 229/103 |
| 6,533,164 | B1 | * | 3/2003 | Correll | 229/150 |
| 7,051,919 | B1 | * | 5/2006 | Walsh | 229/103 |

* cited by examiner

*Primary Examiner* — Gary Elkins

(74) *Attorney, Agent, or Firm* — Leyendecker & Lemire, LLC

(57) ABSTRACT

A clamshell container having a cover portion and a tray portion connected by a living hinge wherein the corners of the sidewalls in at least the tray portion are perforated or scored to permit easy separation by a user to create a substantially flat serving tray is described.

20 Claims, 6 Drawing Sheets

CLAMSHELL CARTON WITH CONVERTIBLE TRAY

RELATED APPLICATIONS

This application claims priority to and fully incorporates by reference Provisional Patent Application No. 61/713,677 filed on Oct. 15, 2012 and having the same name and inventorship as the present application.

FIELD OF THE INVENTION

The invention generally pertains to disposable food cartons for containing a food article to facilitate transport thereof.

BACKGROUND

Clamshell cartons are widely used for serving fast food in high-volume outlets in North America as well as in many parts of the world. These cartons provide a sturdy means to temporarily store hamburgers and sandwiches between the time these meals are served and the moment the cartons are opened to retrieve the meals. Most recognizably, clamshell cartons are used by both McDonalds of Oakbrook, Ill. and Burger King of Miami, Fla. to contain the iconic Big Mac™ and Whopper™ hamburgers.

As is a common practice among many consumers of fast food, the clamshell carton serves not only as a means to transport its contents, but as a convenient serving container replacing the need for a plate or other dish upon which to rest the sandwich/hamburger between bites. Practically, however, the clamshell container was not designed primarily as a serving container, but rather as a means to protect and prevent disassembly of a hamburger while it is being transported. As can be appreciated, to assist in maintaining the hamburger's integrity, the hamburger usually occupies almost the entirety of a designated clamshell container's volume with the edges of the burger often coming in contact with the opposing walls of the container.

Accordingly, when the container is opened and a cover portion is flipped away from a tray portion along a common living hinge, access to the hamburger is limited. When reaching to retrieve the meal, there is very little space for consumer to insert his/her fingers and grab the burger. Consumers must work their fingers around the sides of the sandwiches, rubbing the outside of their fingers alongside the inner walls of the carton in order to reach below the meal in an effort to grab and then lift the sandwich. This is an awkward and inconvenient process.

The problem is exacerbated when the consumer uses the container as a serving tray and, accordingly, repeatedly re-inserts and removes the sandwich from the tray. In addition, consumers must lower their meals carefully so that they are placed inside the tray in a flat, resting position. This requires extra focus or concentration. If the hamburgers are not carefully lowered inside the walls of the carton, spillage of the burger contents may result. For example, if a hamburger is being re-inserted into a carton and part of the burger is placed on the lower carton's wall, the hamburger will lie at an angle. As a result, some of the hamburger contents may slide or spill out.

Figure 1:
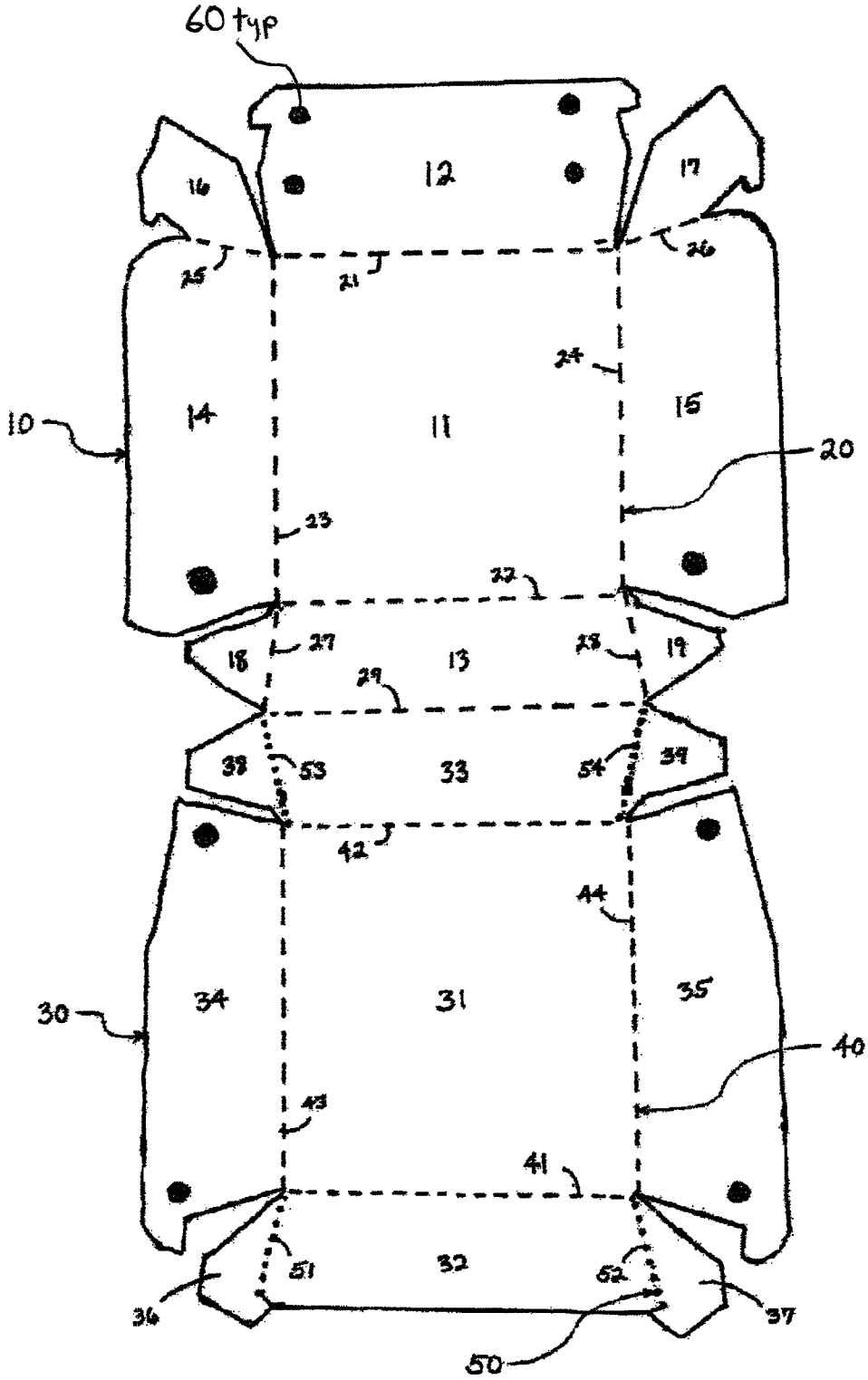
FIG. 1 is a top view of the present invention in its preassembled configuration as a stamped and scored blank according to one embodiment of the present invention.

As a general point of reference, folds (or fold lines) are illustrated in the figures as dashed lines; whereas, folds including perforations are shown in dotted lines.

DETAILED DESCRIPTION

Embodiments of the present invention comprise a clamshell container having a cover portion and a tray portion connected by a living hinge wherein the corners of the side walls in at least the tray portion are perforated or scored to permit easy separation by a user to create a substantially flat tray. Advantageously, the problems with eating from a clamshell container of the prior art design discussed above are ameliorated.

Terminology

The terms and phrases as indicated in quotes (" ") in this section are intended to have the meaning ascribed to them in this Terminology section applied to them throughout this document including the claims unless clearly indicated otherwise in context. Further, as applicable, the stated definitions are to apply, regardless of the word or phrase's case, to the singular and plural variations of the defined word or phrase.

The term "or" as used in this specification and the appended claims is not meant to be exclusive rather the term is inclusive meaning "either or both".

References in the specification to "one embodiment", "an embodiment", "a preferred embodiment", "an alternative embodiment" and similar phrases mean that a particular feature, structure, or characteristic described in connection with the embodiment is included in at least an embodiment of the invention. The appearances of the phrase "in one embodiment" in various places in the specification are not necessarily all meant to refer to the same embodiment.

The term "couple" or "coupled" as used in this specification and the appended claims refers to either an indirect or direct connection between the identified elements, components or objects. Often the manner of the coupling will be related specifically to the manner in which the two coupled elements interact.

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiments and are not necessarily intended to be construed as limiting.

The term and phrase "folds" and "fold lines" are used interchangeably herein. Folds refer to linear progressions on the carton or carton blank that facilitate bending or folding. The folds can be formed by any suitable means. In corrugated fiberboard, fold lines can be formed by compacting the corrugations to create a crease that folds easily relative to the thicker material surrounding the fold line. Scoring is another means of creating fold lines wherein the thickness of the material at the desired fold is reduced relative to surrounding material by slicing into the material a portion of its thickness. Scoring is often utilized with solid sheet materials such as paperboard (also referred to as cardboard) that cannot be easily compressed. Other means of creating fold lines are also possible and contemplated for use with the present invention.

"Perforated fold lines" refer to fold lines that have been perforated. Perforations refer to holes, punctures, notches or slices through a sheet material. Perforated lines refer to linear progressions wherein there are perforations alternating with unperforated portions. Perforations make a fold line much easier to tear or rip.

The terms "Sandwich", "Hamburger" and "Burger" are all used interchangeably herein.

An Embodiment of a Clamshell Carton Having Perforated Sidewall Corners

An embodiment of the clamshell carton of the present invention is illustrated in FIGS. 1-6. The carton is typically fabricated from a single piece of paperboard or corrugated fiberboard that is stamped from sheet stock and either simultaneously or subsequently scored, creased and/or perforated. The stamped and prepared sheet blank is formed into the container having the upper cover portion 10 and the lower tray portion 30 by folding the blank and adhesively bonding various tabs on select sidewalls to adjacent sidewalls. The cover and tray portions are joined together at a fold line that forms a living hinge 29.

Referring to FIG. 1, the prepared blank is shown. The cover portion 10 of the blank includes a generally square top central panel 11 that forms the top side of the cover when assembled. An outer edge of the central panel intersects with a cover front sidewall 12 along a fold line 21. An inner edge of the central panel intersects with a cover rear sidewall 13 along a fold line 22. Cover left and right sidewalls 14 & 15 intersect with the central panel at fold lines 23 & 24 respectively.

On a front edge of each of the left and right sidewalls attached by way of fold lines 25 or 26, a flap 16 or 17 is provided. The flap is configured to overlap the cover front sidewall 12 during assembly and be adhesively bonded to the cover front sidewall. Black dots 60 are provided in various locations on the blank and represent locations where adhesive may be placed to join the various applicable elements of the carton together in its assembled form.

On the respective left and right sides of the cover rear sidewall 13 respective left and right flaps 18 & 19 are attached thereto by way of fold lines 27 & 28. Each flap overlaps one of the back edges of the left and right sidewalls and is adhesively secured to the respective sidewall during assembly. The bottom edge of the cover portion's rear sidewall 13 forms a living hinge 29 with the tray rear sidewall 33 operatively connecting the cover and tray portions of the clamshell carton.

Still referring to FIG. 1, the tray portion of the blank includes a generally square bottom central panel 31 that forms the bottom side of the tray when assembled. An outer edge of the central panel intersects with a tray front sidewall 32 along a fold line 41. An inner edge of the central panel intersects with the tray rear sidewall 33 along a fold line 42. Tray left and right sidewalls 34 & 35 intersect with the central panel at fold lines 43 & 40 respectively.

Left and right flaps 38 & 39 and 36 & 37 respectively are provided on the both the tray rear sidewall 33 and the tray front sidewall 32. The flaps are joined to the sidewalls by fold lines 51, 52, 53 & 54. These fold lines differ from the other fold lines of the blank in that the fold lines are further perforated or otherwise formed to permit easy tearing. In some variations, dashed or dotted lines may be printed on, over or next to the fold lines to clearly indicate to a consumer where to tear during use to form the substantially flat eating tray. To assemble the tray portion of the carton, the flaps are adhesively secured to the inside surface of the tray left and right sidewalls 34 & 35.

Figure 2:
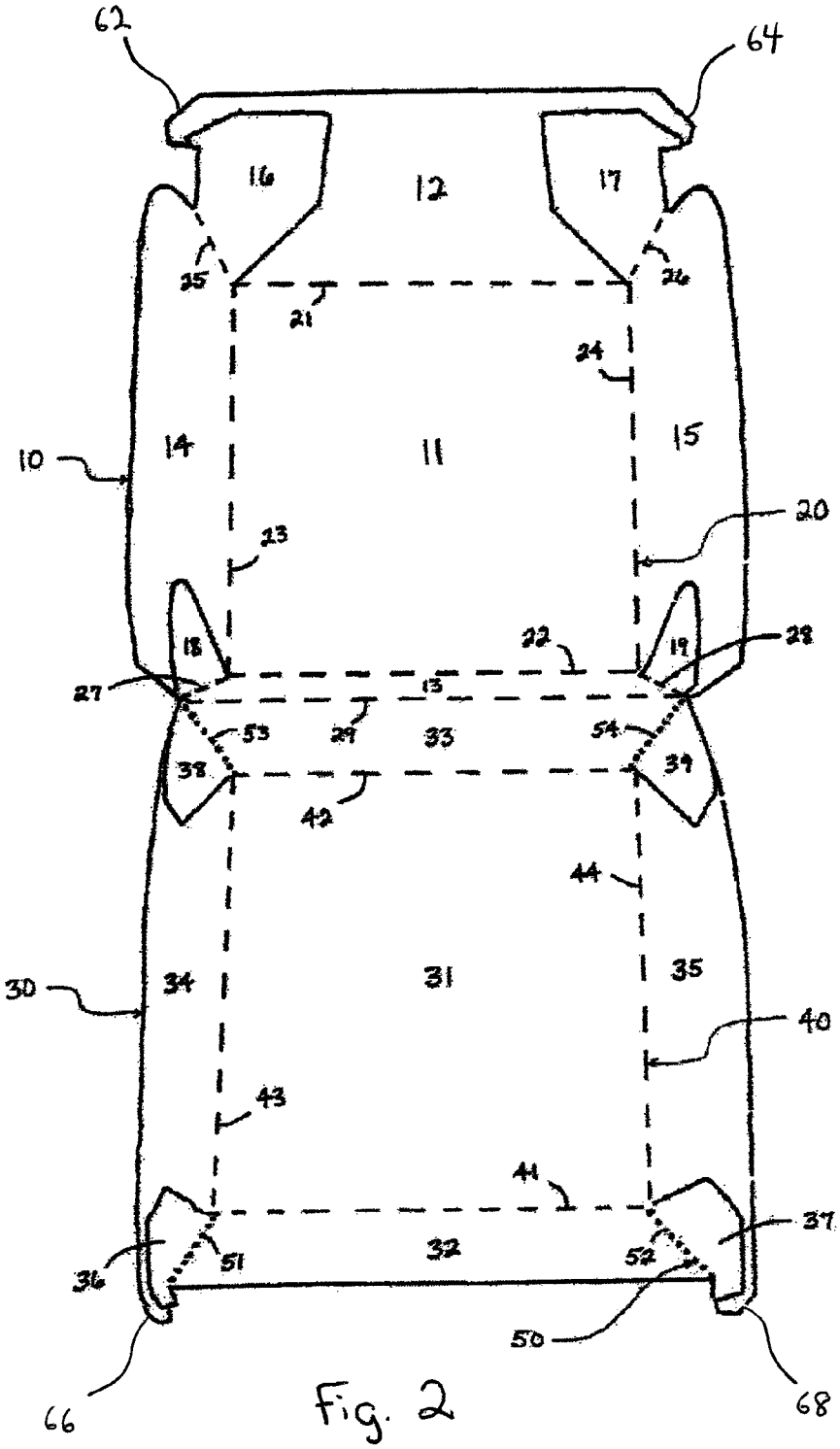
FIG. 2 is a top view of the present invention in its open (or nesting) and assembled configuration according to one embodiment of the present invention.
Figure 6:
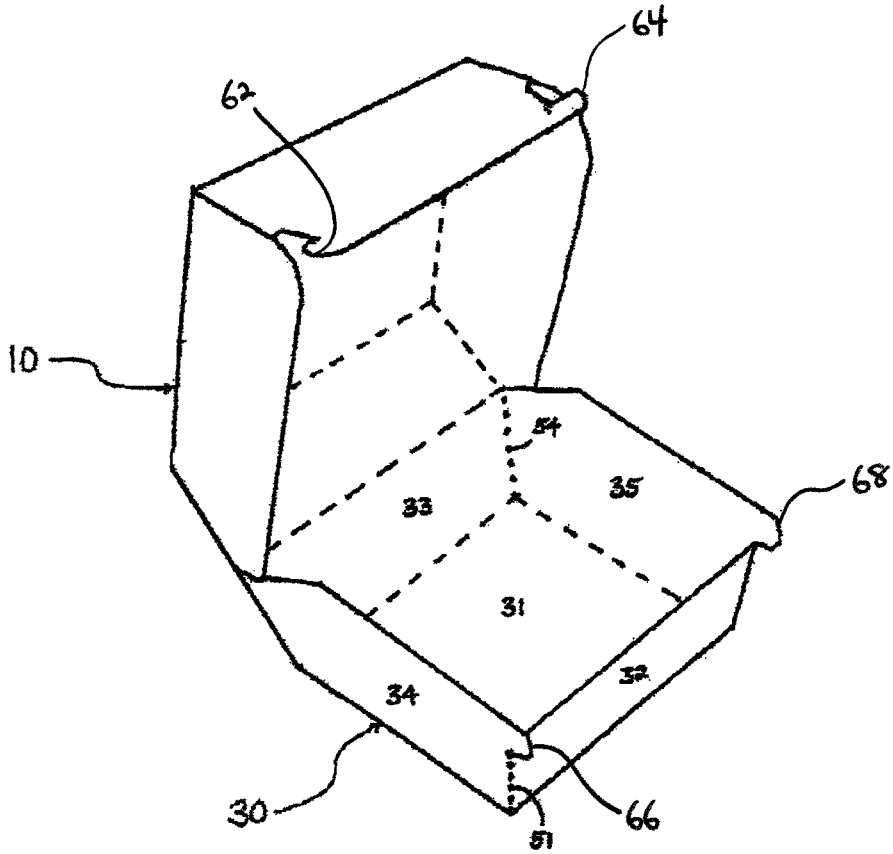
FIG. 6 is an upper perspective view of an assembled clamshell carton according to one embodiment of the present invention.

FIG. 2 shows the carton assembled but not closed. This configuration can be referred to as the carton's shipping or stacking configuration wherein many cartons can be efficiently stacked one on top of each other for shipping without taking up substantially more space than stacks of flat blanks. It is in this form that the clamshell carton is typically shipped from the carton fabrication facility to an eating establishment that makes use of the cartons. Fabrication operations are often automated wherein adhesive, such as a hot melt adhesive, is applied to the various locations indicated in FIG. 1 and the various sides and flaps are folded to bring the flaps in contact with the sidewalls and adhesive to create the three dimensional form. It is to be appreciated, however, that other means of joining the flaps to adjacent sides can be employed in instead of adhesive bonding, such as but not limited to various types of mechanical fastening. From this configuration a restaurant worker will place a hamburger in the tray portion and rotate the cover along the living hinge 29 joining the tray and cover rear sidewalls until the cover encloses and covers the tray. Hooks 62, 64, 66 & 68 formed in the respective tray and cover portions overlap and interlock to hold the cover in place. It is in this serving configuration that the contents are typically provided to a consumer. FIG. 6 illustrates the configuration of the carton just prior to being closed.

Figure 3:
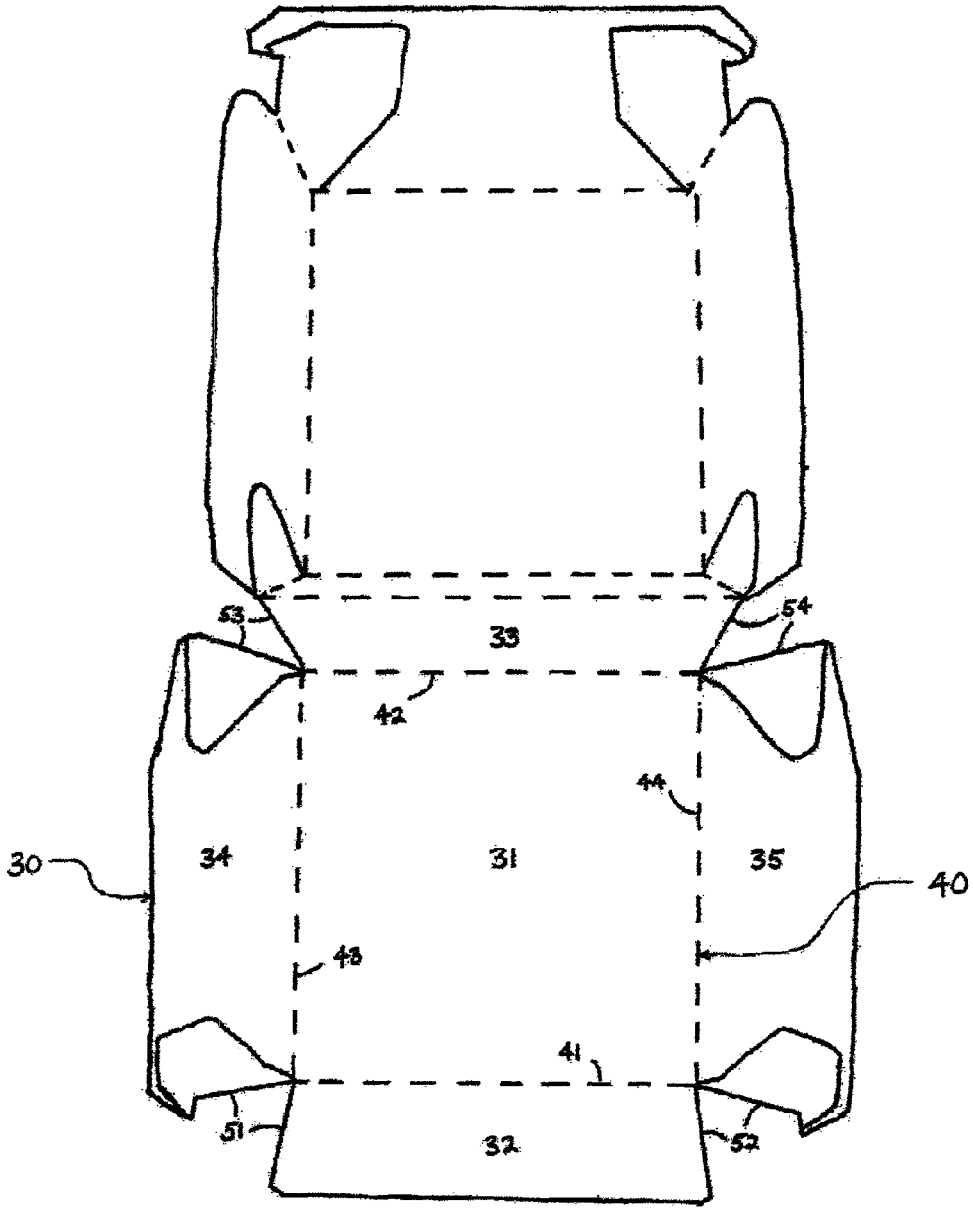
FIG. 3 is a top view of the present invention with the tray portion opened and flattened to act as an improved serving plate according to one embodiment of the present invention.
Figure 4:
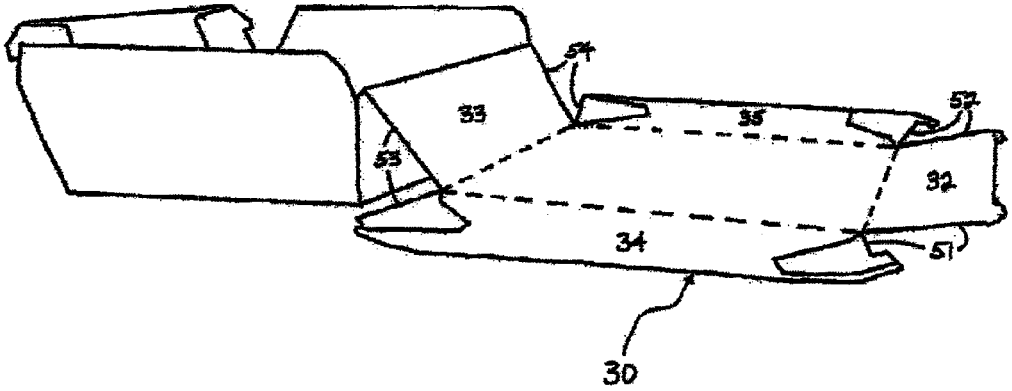
FIG. 4 is a side view of the present invention with the tray portion opened and flattened to act as an improved serving plate according to one embodiment of the present invention.
Figure 5:
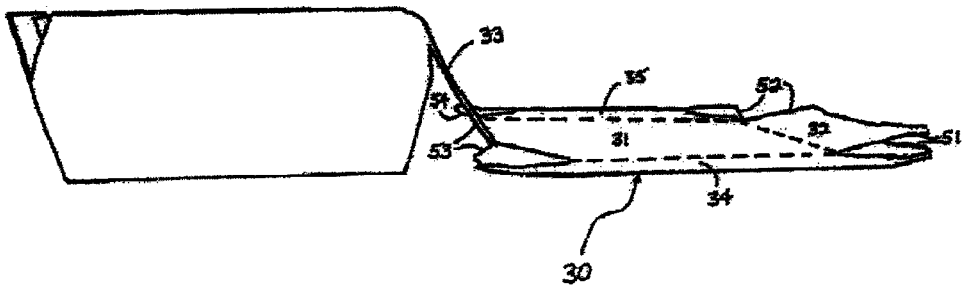
FIG. 5 is another side view of the present invention with the tray portion opened and flattened to act as an improved serving plate according to one embodiment of the present invention.

FIGS. 3-5 show the carton from various perspectives after the perforated folds 51, 52, 53 & 54 in the sidewall corners have been torn by a user and the tray sidewalls 32, 34 & 35 have been laid flat to allow the user to more easily access the food contained therein. Effectively, a plate like surface is created that permits the user to easily grab the hamburger and lift it from the carton, as well as, place the hamburger back on the tray without having to maneuver around upturned sidewalls.

In some embodiments, printed indicia can be provided on or proximate the perforated fold lines 51, 52, 53 & 54, either or both on the inside or outside surfaces of the lines. The indicia can comprise a dashed or dotted line indicating where a user may tear the carton. Illustrations or writing can also be provided, such as the words "Tear Here" and/or pictures of scissors.

In other embodiments, additional fold lines may be perforated. For instance, fold lines 41, 43 & 44 may be perforated to permit a user to completely remove the sidewalls leaving only the bottom central panel of the tray. Fold line 42 can also be perforated to allow the bottom panel to be completely separated from the remainder of the carton to act as a separate and distinct plate-like flat surface.

The fold line corresponding to the living hinge 29 joining the tray and cover portions can also be perforated in certain embodiments so that the cover and tray portions 10 & 30 of the carton can be separated from one another.

The actual location of the perforations is not limited to the corner fold lines. Rather, lines of perforations can run in any suitable configuration on the sidewalls 32, 33, 34 &35 of the tray portion that facilitate the creation of a flat plate-like tray when torn.

The illustrated clamshell carton is rectangular in its basic shape. However, carton variations are contemplated having different shapes, such as square, pentagonal, hexagonal, octagonal or triangular with similar functional features as the illustrated embodiment. Further, while the cover and tray portions typically share a similar shape, this is not always the case.

A Method of Making an Embodiment of the Clamshell Carton

As mentioned above, embodiments, such as the illustrated embodiment, are fabricated from planar sheets of paperboard and or corrugated fiberboard. The cartons can also be fabricated of plastic sheet, which may or may not be of the corrugated variety. Typically, the sheet stock is die cut into a unitary blank as shown in FIG. 1 using a die cutting press. The press can be configured to cut a stack of many sheets or it can be configured to cut a single sheet. When a multiple sheet cutting process is utilized, only the outer shape of the blank is typically cut; whereas, when a single sheet is cut the die cutting tool can be configured to form some or all of the creases, scores and perforations desired or necessary in the blank.

Cutting is accomplished with a die cutter using a knife edge that slices completely through the sheet. In contrast a crease is formed using a blunt edge that does not cut the sheet material but collapses it when pressure from the press is applied. Scores can be formed using a knife edge that only partially penetrates the sheet leaving a significant portion uncut. Perforations can be formed using an undulating knife edge that only penetrates the sheet material at select locations leaving the material on either side of a slit or hole uncut.

In some variations, the blank's features are formed by other means. For instance, rather than utilize a press and a die to form the creases, scores, perforations and slits, rotating circular knifes and/or disks with appropriate circumferential faces can be used to form the features using appropriately configured automated machinery. It is to be appreciated that the blanks can be cut from sheet stock and the various other features of the blank formed using a variety of processes in a variety of different orders as would be obvious to one of ordinary skill in the art to which the invention pertains.

After the blank is formed, adhesive drops and or beads are applied in the appropriate locations, such as the locations 60 indicated in FIG. 1 and the associated flaps are folded over and pressed against the adhesive to secure them in place and form a three dimensional tray. As necessary, automated machinery is utilized to lay down the adhesive, fold the flaps and sides of the blank into a desirable position and maneuver and press the flaps into place. Often hot melt thermoplastic adhesives can be used, although in other embodiments a pressure sensitive adhesive can be used as well.

The clamshell carton produced is typically in a stacking configuration as shown in FIG. 2, wherein the cover has not yet been flipped or rotated along the living hinge to cover the tray. It is typically in this form that the carton is shipped to restaurants and fast food establishments. At the food provider, individual cartons are lifted from a stack and sandwiches are placed therein before the cover is closed over the tray and the food product is served to a consumer.

A Method of Using an Embodiment of the Clamshell Carton

In use a newly prepared sandwich or hamburger is placed on the bottom central panel 31 of the bottom or lower tray portion 30 by a food service worker. The upper tray cover 10 is folded over the sandwich and lower tray portion until the respective hooks 62-68 interlock to secure the carton in its closed serving configuration. It is in this configuration that the sandwich is delivered to a purchaser and ultimately the intended consumer.

The consumer opens the carton to reveal the sandwich by pulling upwardly on the cover portion thereby releasing the hooks and folding the cover portion rearwardly along the living hinge 29. Often the cover portion will be used as a receptacle for other food items, such as French fries which may be poured into it.

Once the cover portion is folded out of the way, the consumer then proceeds to tear the tray portion at the corner perforations 51,52, 53 & 54 and lower the respective sides 32, 34 & 35 to form a flat plate like surface as best shown in FIGS. 4 & 5. The sandwich can now be lifted from the sides without the consumer having to maneuver his/her hands around the formerly upwardly extending sides of the tray. Similarly, the sandwich can be placed back on the tray portion without having to negotiate the sidewalls. Once the meal has been consumed the carton can be disposed of in the traditional manner.

Other Variations and Embodiments

The foregoing description of the invention has been presented for purposes of illustration and description and is not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

I claim:

1. A clamshell carton formed from a single unitary sheet blank, the clamshell carton comprising:

a tray portion including (i) a bottom panel having a plurality of perimeter edges, and (ii) a plurality of tray sidewalls including a rear tray sidewall, each tray sidewall extending upwardly from an associated perimeter edge of the plurality of perimeter edges at a fold therewith, each of the sidewalls being joined to adjacent tray sidewalls by perforated folds; and a cover portion configured to fit over and cover the tray portion, the cover portion including (i) a top panel having a plurality of perimeter edges, and (ii) cover sidewalls including a rear cover sidewall, each cover sidewall extending upwardly from an associated perimeter edge of the plurality of perimeter edges at a fold therewith, each of the cover sidewalls being joined to adjacent cover sidewalls at folds;

wherein a top edge of the rear tray sidewall is joined to the rear cover sidewall by way of a perforated fold forming a living hinge;

wherein when each of the perforated folds of the tray portion and the living hinge are torn, a substantially planar tray with no sidewalls is formed and the cover portion is transformed into an independent receptacle.

2. The clamshell carton of claim 1, wherein the sheet blank comprises a corrugated fiberboard.

3. The clamshell carton of claim 1, wherein the sheet blank comprises paperboard.

4. The clamshell carton of claim 1, wherein the plurality of tray sidewalls includes a front tray sidewall, a left tray sidewall, a right tray sidewall and the rear tray sidewall, wherein the tray sidewalls are joined by way of a plurality of sidewall flaps, each sidewall flap being joined to one tray sidewall by a perforated fold and adhesively adhered to an adjacent tray sidewall.

5. The clamshell carton of claim 1, wherein indicia is printed proximate each of the perforated folds serving to indentify to an observer that the fold is perforated.

6. The clamshell carton of claim 4, wherein:

a left rear flap and a right rear flap of the plurality of sidewall flaps are secured with the rear tray sidewall on respective left and right ends thereof, the left rear sidewall flap is further adhesively secured to a left tray sidewall of the plurality of tray sidewalls, and the right rear sidewall flap is further adhesively secured to a right tray sidewall of the plurality of tray sidewalls; and a left front flap and a right front flap of the plurality of flaps are secured with the front tray sidewall on respective left and right ends thereof, the left front flap is further adhesively secured to the left tray sidewall, and the right front flap is further adhesively secured to the right tray sidewall.

7. A method of making the clamshell carton of claim 4, the method comprising:

stamping a blank from one of a sheet of corrugated fiberboard or a sheet of cardboard;

one of creasing or scoring the blank at select locations to create folds;

perforating the folds adjoining tray sidewalls and flaps;

applying adhesive to the tray and cover sidewalls in select locations; and folding the blank along the folds and pressing tray sidewall flaps and cover sidewall flaps against locations of the respective tray and cover sidewalls having adhesive applied thereto.

8. The method of claim 7, further comprising:

printing indicia on the blank proximate the location of the perforated folds.

9. The method of claim 7, wherein the sheet comprises corrugated fiberboard.

10. The method of claim 7, wherein the sheet comprises paperboard.

11. The method of claim 9, wherein one of said creasing or scoring comprises creasing.

12. The method of claim 10, wherein one of said creasing or scoring comprises scoring.

13. A method of using the clamshell carton of claim 1:

receiving the clamshell carton in a closed configuration with a sandwich contained therein;

opening the clamshell carton by releasing the cover portion from the tray portion and rotating the cover portion rearwardly along the fold line adjoining the cover rear sidewall and the tray rear sidewall;

tearing apart the perforated folds;

lowering one or more of the tray sidewalls to lie generally flat against an underlying surface and create a modified tray; and removing the sandwich from the carton by lifting the sandwich off of the modified tray.

14. The method of claim 13, further comprising:

placing the sandwich back on the modified tray after the step of removing the sandwich.

15. A clamshell carton formed from a single unitary sheet blank, the clamshell carton comprising:

a tray portion including (i) a bottom panel having a plurality of perimeter edges, (ii) a plurality of tray sidewalls including a rear tray sidewall, a front tray sidewall, a left tray sidewall and a right tray sidewall, each tray sidewall extending upwardly from an associated perimeter edge of the plurality of perimeter edges at a fold therewith, each of the tray sidewalls being joined to adjacent tray sidewalls at ends thereof to form corners and (iii) a plurality of lines of perforations each extending from a perimeter edge to a top edge of a tray sidewall wherein by tearing the plurality of lines of perforations the tray sidewalls are effectively detached from each other so that at least the front, left and right tray sidewalls are laid flat and generally planar with the bottom panel; and a cover portion configured to fit over and cover the tray portion, the cover portion including (i) a top panel having a plurality of perimeter edges, and (ii) cover sidewalls including a rear cover sidewall, each cover sidewall extending upwardly from an associated perimeter edge of the plurality of perimeter edges at a fold therewith, each of the cover sidewalls being joined to adjacent cover sidewalls at folds;

wherein a top edge of the rear tray sidewall is joined to the rear cover sidewall by way perforated fold forming a living hinge;

wherein when each of the perforated folds of the tray portion and the living hinge are torn, a substantially planar tray with no sidewalls is formed and the cover portion is transformed into an independent receptacle.

16. The clamshell carton of claim 15, wherein the plurality of perforated lines includes perforated lines located in each of the corners joining adjacent tray sidewalls.

17. The clamshell carton of claim 15, wherein the plurality of perforated lines have been torn and at least the left, right and front tray sidewalls are disposed in a planar relationship with the bottom panel.

18. The clamshell cover of claim 15, wherein indicia is printed proximate each of the perforated lines serving to identify to an observer where to tear.

19. A method of using a clamshell carton containing a sandwich, the method comprising:

receiving the clamshell carton in a closed configuration with the sandwich contained therein, the clamshell carton comprising:

a tray portion including (i) a bottom panel having a plurality of perimeter edges, and (ii) a plurality of tray sidewalls including a rear tray sidewall, each tray sidewall extending upwardly from an associated perimeter edge of the plurality of perimeter edges at a fold therewith, each of the sidewalls being joined to adjacent tray sidewalls by perforated folds; and a cover portion configured to fit over and cover the tray portion, the cover portion including (i) a top panel having a plurality of perimeter edges, and (ii) cover sidewalls including a rear cover sidewall, each cover sidewall extending upwardly from an associated perimeter edge of the plurality of perimeter edges at a fold therewith, each of the cover sidewalls being joined to adjacent cover sidewalls at folds wherein a top edge of the rear tray sidewall is joined to the rear cover sidewall by way of a perforated fold forming a living hinge;

opening the clamshell carton by releasing the cover portion from the tray portion and rotating the cover portion rearwardly along the living hinge;

tearing apart each of the perforated folds of the tray portion;

tearing apart the perforated fold of the living hinge;

lowering each of the tray sidewalls to lie generally flat against an underlying surface and create a planar tray; and accessing the sandwich from the planar tray with no interference from the tray sidewalls.

20. The method of using a clamshell carton containing a sandwich of claim 19, the method further comprising:

separating the cover portion from the tray portion; and using the separated cover portion as a receptacle for another food item.

* * * * *